United States Patent [19]

Kanaga

[11] 4,155,581

[45] May 22, 1979

[54] SCOOP CONTAINER AND METHOD OF MANUFACTURE THEREOF

[76] Inventor: Stephen R. Kanaga, P.O. Box 1033, San Mateo, Calif. 94403

[21] Appl. No.: 874,026

[22] Filed: Feb. 1, 1978

[51] Int. Cl.[2] ..... A47L 13/52; B65F 1/00

[52] U.S. Cl. ..... 294/55; 294/1 R; 229/38; 93/58 R

[58] Field of Search ..... 294/55, 1 R, 19 R; 15/104.8, 257.1; 229/38, 410, 19

[56] References Cited

U.S. PATENT DOCUMENTS

| | | | |
|---|---|---|---|
| 3,639,937 | 2/1972 | Sweeney | 15/257.1 |
| 3,767,247 | 10/1973 | Wetzler | 294/1 R |
| 3,857,597 | 12/1974 | Young | 294/55 |
| 3,971,503 | 7/1976 | Allan et al. | 294/1 R |

*Primary Examiner*—James B. Marbert

[57] ABSTRACT

An openable and closable light-in-weight disposable container for temporarily receiving and retaining scooped up excretions deposited by pets on city sidewalks and streets as well as on the premises of pet owners; such container having numerous other uses in other environments, such as for facilely picking up oily sawdust and debris from garage floors and for readily removing accumulated swept up dirt, heavy dust and the like for convenient disposal in a nearby dust bin or other trash receptacle.

6 Claims, 7 Drawing Figures

SCOOP CONTAINER AND METHOD OF MANUFACTURE THEREOF

In the environment of pets and their care, there have been an increasing number of U.S. Letters Patent issued in recent years which variously describe and claim improvements pertaining to the removal of excretia especially clean-up devices. A majority of these devices are constructed of two or more co-acting parts which often become jambed or the members thereof bind to render the entire unit useless. Other disadvantages of prior devices of this general nature are of cumbersome construction to make them difficult to carry and to handle or manipulate often resulting in the spilling of the picked up messes before reaching a disposal receptacle. The present invention is directed to the provision of an easily handled unitary compact structure which can be carried on the person and brought into usable condition in seconds, used, and then quickly closed for carrying to a nearby trash can or other disposal leaving a sidewalk or curb clean and free of a pet's mess.

A primary object of my invention is to provide a scoop container which is readily and inexpensively manufactured from light-in-weight material and which is foldable into compact form for carrying about in a person's pocket or in a handbag prior to use; such scoop container being adapted to be unfolded and automatically sprung to scoop form for instant use in removing a pet's excretions as well as the picking up of other deleterious or unsightly or unclean matter from surfaces.

Another important object of the present invention is to provide a scoop container of the indicated nature which is additionally characterized by its capability of being carried about in its unfolded, usable form by an individual, and easily closable to prevent spillage of the contents therefrom.

A further object of the invention is to provide a scoop container of the aforementioned character which can be produced at a minimum of cost from reconstituted paper board of ten to fourteen point stock, or even heavy paper stock.

In its preferred form and best mode of construction, my improved scoop container comprises a single ply sheet having a longitudinally extending fold line at approximately the transverse center thereof; and a transversely extending fold line at approximately the longitudinal center thereof, as well as having two sets of fold lines extending disgonally from opposite ends of said sheet to opposite ends of said transverse fold line thereby providing when folded on said diagonal lines a scoop base at one end of said sheet onto which picked up material is disposed and upstanding tapered sides to prevent side spillage of picked up material, and providing when folded on said other set of diagonal lines and also when additionally folded on said transversely extending fold line a container cover or lid with tapered depending sides overlapping the scoop sides and overlying relation to said scoop base, and coatings of pressure-sensitive adhesive on extremity portions of said single ply sheet for detachably securing the opposite depending sides of said lid to the upstanding sides of said scoop when pinched together.

Referring to the drawings.

Figures 1, 2, 2A, 2B, 3, 4, 5:
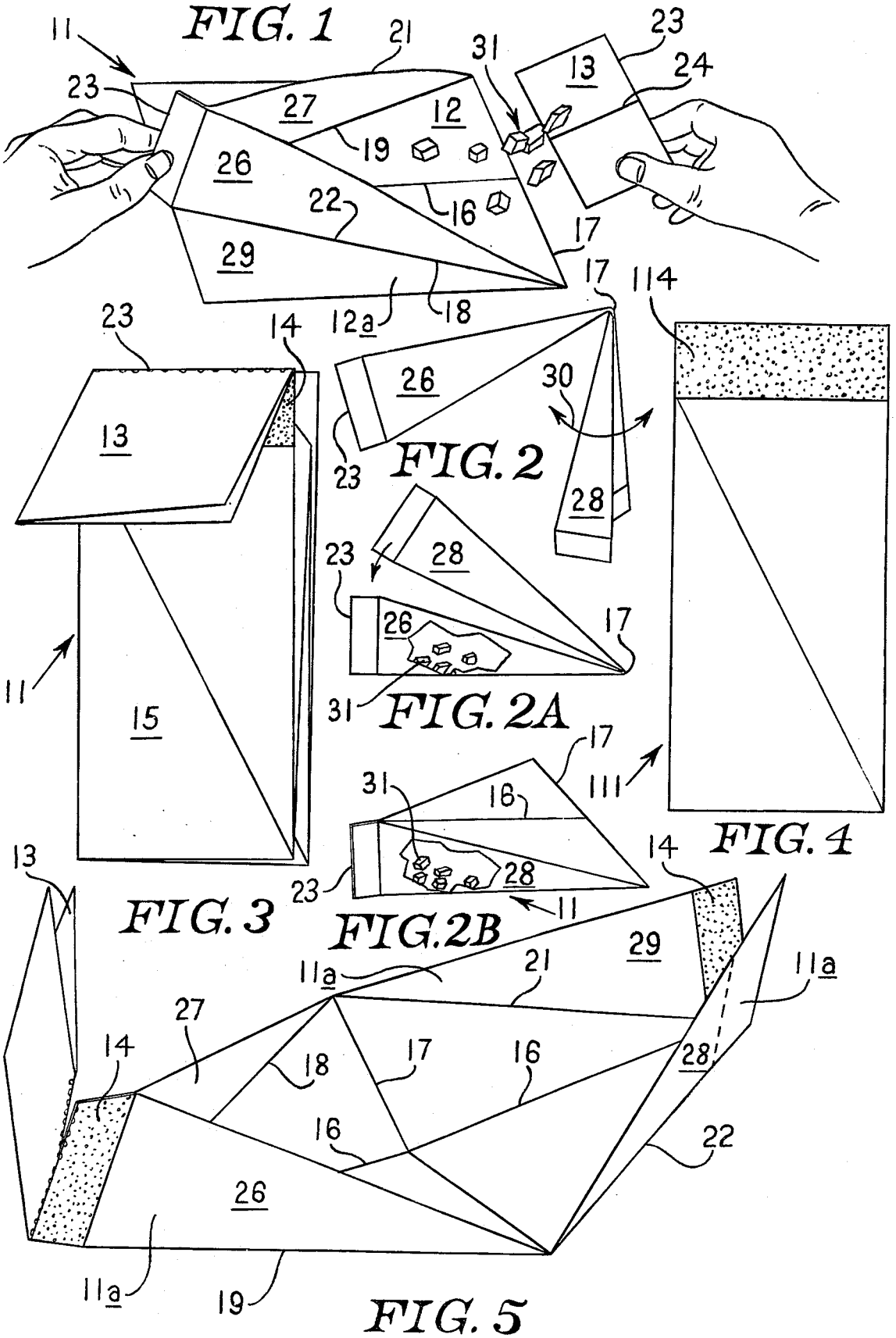
FIG. 1 is an exploded perspective view of a preferred embodiment of the invention illustrating the upstanding double wall sides and base of the assembled container section and the detached or separated scoop section for pushing the picked up material into the container.
FIG. 2 is a side elevational view of a partially unfolded scope container before closing the same.
FIG. 2A is another side elevational view of the embodiment of FIG. 1 in a different unfolded position thereof, this view being broken away at one side thereof to illustrate the location of picked up material on the base of the partially assembled container section.
FIG. 2B is a reduced perspective view of the embodiment of FIG. 1 showing the final closed position of the container with detachably secured sides; this view also being broken away at a double-wall side thereof to illustrate the location of a picked up material on the base of the closed container.
FIG. 3 is an elevational view of my improved scoop container embodiment of FIG. 1 shown in packet form as folded for carrying in a pocket or handbag.
FIG. 4 is an elevational view of a modified embodiment of the invention.
FIG. 5 is a development of my improved scoop container provided with score lines upon which the single blank or sheet is folded to form the packet shown in FIG. 3.

As particularly illustrated in FIGS. 1 and 5 of the annexed drawings, I provide a disposable scoop container which is generally designated by the reference numeral 11 and which is readily and inexpensively manufactured from re-constituted paper board of ten or fourteen point stock. Other suitable light-weight material, such as bendable plastic, can be employed for constructing the container 11, if desired, which is shown in FIG. 3 in the flat folded form or packet 15 as it is machine-folded upon production, and which is shown in FIG. 1 in unfolded condition as it is used.

In accordance with my present invention the scoop container 11 is conveniently manufactured from a single sheet **11*a* which is scored during its manufacture as hereinafter described with a plurality of fold lines so that when folded thereon to set up a container section for use, a flat container base 12 is provided onto which material picked up is temporarily disposed. Also, during its manufacture a tear-off tab 13 is provided which when detached may serve as a scoop for pushing material into the container section for disposal onto base 12 thereof, in much the same manner as picking up material with a standard dust pan, for emptying into a nearby trash can or dust bin. During its manufacture, I cause to be applied to opposite extremities of the sheet 11*a*, areas of a pressure-sensitive adhesive 14** for detachably securing the container section of the scoop container together, or with latex self-seal adhesive.

As illustrated in the annexed drawings, the sheet **11*a* is scored during its manufacture with a longitudinally extending fold line 16 at the transverse center thereof as well as with a transverse score line 17 spanning the sheet at the longitudinal center thereof, and also is provided with two sets of diagonally extending fold lines of which one set of such diagonal lines consists of a score line 18 extending from adjacent one end of such sheet 11*a* to one end of said transverse fold line 17 and of another diagonal score line 19 extending from adjacent to said one end of sheet 11*a* to the other or opposite end of said transverse score line 17. The other set of said two sets of diagonal score lines consists of a score line 21 extending from adjacent to the opposite end of said sheet 11*a* to one end of said transverse score line 17 and a diagonal fold line 22 extending from adjacent to said opposite end of said sheet 11***a* to the other or opposite end of said transverse fold line 17. As indicated in FIGS. 3 and 5, I also provide during the manufacture of my scoop container as exemplified in FIG. 1, a perforated score line 23 extending transversely of sheet 11*a* adjacent to one end thereof to provide the tab 13 which also is scored transversely so as to provide a short fold line 24 therein upon which it can be folded upon itself when desired to fashion the sheet into a packet 15 fitting the inside pocket of a man's coat or jacket or for placing in a handbag convenient for grasping and unfolding for use as illustrated in FIG. 1. In this packet forming operation the sheet 11*a* is folded on longitudinally extending fold line 16, and extension 24 which spans the tab 13.

In FIGS. 2, 2A and 2B, I have illustrated the steps taken in setting up the scoop container of the present invention for use as depicted in FIG. 1, as well as for disposal when closed. Whenever a pet disposes excretia on a sidewalk or in the street, the holder of my scoop container 11 promptly removes the packet 15 from his pocket or from her handbag and unfolds the sheet 11*a*, after first tearing off the tab 13. Upon unfolding the sheet 11*a* on line 16, there is an automatic springing up of sides 26 and 27 on the container section 11 and the dropping of the cover or lid section 12*a* on the score line 17 to a position depending therefrom as illustrated in FIG. 2. The pet owner or walker then folds the section 12*a* into an underlying position with respect to the base 12 of the container section, see FIGS. 1 and 2, which furnishes a support or reinforcement to the base 12 as well as the the upstanding sides 26 and 27; the container section assuming the position shown in FIG. 1 when placed on the sidewalk or street gutter so as to receive the excreta when pushed onto the base 12 by the scoop section 13. After the mess has been picked up, the container is raised and the lid section is swung from underneath the bottom of base 12 thereof and up and over the container section 11, as illustrated in FIG. 2A with automatic movement of the sides 28 and 29 of the lid section 12*a* assuming the positions shown; movement of said lid section 12*a* being made on the score line or hinge 17, as indicated by the short arrows 30. Thereafter, to prevent escape from the container section of the collected mess or material, which is designated generally by the reference numeral 31, the pet walker presses the cover 12*a* downwardly onto the container section 11 with the sides 26, 27, 28, and 29 in lapped relationship to provide in effect double side walls and to afford increased rigidity to the scoop container as well as to avoid crushing of the same. The filled scoop container can be disposed in a nearby trash can or taken home for disposal. The filled container is illustrated in FIG. 2B which is broken away to depict the picked up material 31.

A modified embodiment of my invention is illustrated in FIG. 4 of the annexed drawings. This modification is similar in all respects to the preferred embodiment of the invention which is illustrated in FIGS. 1 to 5 inclusive, except the modified scoop container 111 is made to a shorter length by virtue of the elimination of the scoop section at one end thereof; the coating 114 of pressure-sensitive material being still retained adjacent to opposite ends.

It is to be noted that my improved scoop container can be made to any size desired; small, medium and large, for use in scooping up messes from different sizes of dogs. Further, when using the scoop container for picking up oily sawdust and other debris from garage floors, a heavier paper board stock is employed.

It is to be understood that the appended claims are intended to cover not only the embodiments shown but also variations thereof within the scope and purview of the invention.

I claim:

1. A scoop container comprising a sheet of foldable stock, said sheet having a predetermined length and width, a longitudinally extending score line at the transverse center of said sheet upon which it is foldable; spaced apart transversely extending score lines in said sheet defining a removable scoop section, adhesive areas, a container section and a cover section, and two sets of diagonally extending score lines at each end of said sheet upon which it is foldable to define opposite sides on said container section as well as opposite sides on said cover section; said opposite sides on said cover section being in lapped relation to the opposite sides of said container section when the scoop container is closed; said scoop section serving as a scoop when moving material into said container section.

2. A scoop container as set forth in claim 1, and a base in said container section upon which it rests during use; said cover section underlying said base when said container section is open for receiving material thereon.

3. A scoop container as set forth in claim 1 which is foldable into packet form when folded on said score lines for convenient carrying in a coat pocket or a handbag.

4. A scoop container as set for in claim 1 wherein said adhesive areas are located at one end of said container section and at one end of said cover section, and in which a layer of a pressure-sensitive adhesive is disposed.

5. A scoop container as set forth in claim 1 wherein one set of said two sets of diagonally extending score lines at one end of said sheet consists of one score line extending from one end of said container section of said sheet at one side thereof to one end of the transversely extending score line at the other end of said container section at said one side of said sheet and also consists of another score line extending from said longitudinally extending score line at said one end of said container section of said sheet to the other end of said transversely extending score line at said other end of said container section at the said one side of said sheet to define one side of said container section at said one side of said sheet, and wherein the other set of said two sets of diagonally extending score lines at said one end of said sheet consists of one score line extending from the said one end of the container section of said sheet on the other side thereof to the other end of said transversely extending line at said other end of said container section at said other side of said sheet, and the other of said diagonally extending score lines of said other set thereof at said one end of said sheet extending from said longitudinally extending score line at said one end of said container section of said sheet to the other end of said transversely extending score line at the other end of said container section of said sheet at said other side thereof to define a side on said container section at said other side of said sheet, and similar two sets of diagonally extending lines on each side of said sheet extending from the end of said cover section to opposite ends of said transversely extending score line at said other end of said container section to define sides on each side of said cover section.

6. A method of manufacturing a scoop container; said method comprising the steps of providing a planar sheet of predetermined length and width, scoring said sheet on a longitudinal extending line at its transverse center, then scoring said sheet on a plurality of spaced apart transverse lines to define a removable scoop section at one end thereof, adhesive areas, a container section and a cover section when folded thereon, further scoring said sheet diagonally from one end of said container section on both sides thereof to opposite ends of said transversely extending score line at the juncture of said container section and said cover section to provide sides on both said container section and said cover section when folded thereon, and then applying pressure-sensitive adhesive on said adhesive areas for releasably sealing said cover section on said container section.

* * * * *